US012781370B2

(12) United States Patent
Hennebel et al.

(10) Patent No.: US 12,781,370 B2
(45) Date of Patent: Nov. 3, 2026

(54) COPPER ELECTROWINNING PROCESS

(71) Applicant: UMICORE, Brussels (BE)

(72) Inventors: Tom Hennebel, Hoboken (BE); Hans Grade, Hoboken (BE); Daan Hofman, Hoboken (BE); Frederik Verhaeghe, Hoboken (BE)

(73) Assignee: UMICORE, Brussels (BE)

( * ) Notice: Subject to any disclaimer, the term of this patent is extended or adjusted under 35 U.S.C. 154(b) by 1197 days.

(21) Appl. No.: 17/436,745

(22) PCT Filed: Feb. 18, 2020

(86) PCT No.: PCT/EP2020/054196
§ 371 (c)(1),
(2) Date: Sep. 7, 2021

(87) PCT Pub. No.: WO2020/182425
PCT Pub. Date: Sep. 17, 2020

(65) Prior Publication Data

US 2022/0178038 A1 Jun. 9, 2022

(30) Foreign Application Priority Data

Mar. 8, 2019 (BE) ..... 2019/5145

(51) Int. Cl.
*C25C 1/12* (2006.01)
*C25C 7/00* (2006.01)

(52) U.S. Cl.
CPC . *C25C 1/12* (2013.01); *C25C 7/00* (2013.01)

(58) Field of Classification Search
None
See application file for complete search history.

(56) References Cited

U.S. PATENT DOCUMENTS

| | | | | |
|---|---|---|---|---|
| 3,959,112 | A | 5/1976 | Arend, Jr. | |
| 4,053,377 | A * | 10/1977 | Schlain | C25C 1/12 205/148 |
| 6,183,622 | B1 * | 2/2001 | Janik | C25C 1/12 205/296 |
| 2007/0251828 | A1 | 11/2007 | Grazier et al. | |
| 2011/0024301 | A1 * | 2/2011 | Hecker Cartes | C25C 1/12 205/102 |
| 2018/0073156 | A1 | 3/2018 | Ogawa et al. | |

FOREIGN PATENT DOCUMENTS

| | | | | |
|---|---|---|---|---|
| CA | 1020115 | * | 11/1977 | C25C 1/08 |
| JP | H05311259 | A | 11/1993 | |
| JP | H09316679 | A | 12/1997 | |
| JP | 2007503525 | A | 2/2007 | |
| JP | 2016180164 | A | 10/2016 | |
| WO | 2005019502 | A1 | 3/2005 | |

OTHER PUBLICATIONS

English translation JP3774262, also published as JPH09316679, Nikko (Year: 2006).*
W. Charles Cooper, "Advances and future prospects in copper electrowinning", Journal of Applied Electrochemistry, 15, 1985, 789-805. (Year: 1985).*
English translation CN 104694978 (Year: 2015).*
JPO, Notice of Reasons for Rejection for corresponding Japanese Patent Application No. 2021-553094, mailed Feb. 19, 2024, 8 pages.
JPO, Notice of Reasons for Rejection for corresponding Japanese Patent Application No. 2021-553094, mailed Feb. 19, 2024, English translation, 7 pages.
ISA/EP; International Search Report and Written Opinion for International Patent Application No. PCT/EP2020/054196 dated Mar. 27, 2020, 13 pages.
Moeller, C A, et al., "Influence of As, Sb, Bi and O on Copper Anode Behaviour—Part 1: Passivation Characteristics", World of Metallurgy, ERZMETALL, vol. 61, No. 6, Nov. 1, 2008, 11 pages.
Zhou, Wen-Ke, et al., "Reduction and deposition of arsenic in copper electrolyte", Transactions of Nonferrous Metals Society of China, vol. 21, Issue 12, Dec. 1, 2011, 6 pages.
"OLME an HKEX Company: Special Contract Rules for Copper Grade A", The London Metal Exchange, accessed at: https://www.inducorp.co.in/assets/pdf/copper.pdf, 2016, 4 pages.

* cited by examiner

*Primary Examiner* — Stefanie S Wittenberg
(74) *Attorney, Agent, or Firm* — Rimon P.C.; Allyn B. Elliott

(57) ABSTRACT

The present invention concerns a copper electrowinning process suitable for the production of enhanced-quality cathodes from highly contaminated electrolytes. The process is performed in electrowinning cells including a plurality of anodes and cathodes, equipped with gas sparging elements at their bottom. It comprises the step of sparging gas across the cathodes, and is characterized in that the solution contains more than 100 mg/L of arsenic. The invention provides an alternative solution to the problem of cathode quality when dealing with highly contaminated electrolytes, in particular when containing high concentrations of arsenic.

8 Claims, No Drawings

COPPER ELECTROWINNING PROCESS

CROSS-REFERENCE TO RELATED APPLICATIONS

This application is a U.S. National Stage application of International Patent Application No. PCT/EP2020/054196, filed on Feb. 18, 2020, which claims the benefit of Belgian Patent Application No. BE2019/5145, filed on Mar. 8, 2019.

The present invention concerns a copper electrowinning process suitable for the production of enhanced-quality cathodes from highly contaminated electrolytes.

Smelting processes applied to copper-bearing primary or secondary materials typically end up producing a copper-based metallic alloy. This alloy is most often of sulfidic nature, which is then called "matte". Depending upon the materials fed to the smelter, appreciable amounts of other elements may also be collected in this phase, such as precious metals and a suite of impurities such as arsenic, antimony, bismuth, lead, tellurium, and selenium.

The copper-based phase is then subjected to further process steps to recover the precious metals rapidly and with high yield. It is also essential to bring out the copper. According to known processes, copper-based alloys or mattes are finely ground, and then leached in sulfuric acid under oxidizing conditions. Precious metals remain in a residue, which is separated by decantation and/or filtration. The leachate contains copper sulfate and is named "electrolyte" in view of the next process step of electrowinning wherein copper is recovered in the form of cathodes. It will also contain many of the impurities contained in the alloy or matte.

During electrowinning, sulfuric acid is regenerated at the anode. The highly acidic and copper-depleted spent electrolyte is recirculated to the leaching step. Due to this closed loop, the electrolyte gradually accumulates impurities. This accumulation is to be mitigated, which is normally done by diverting a fraction of the total stream of electrolyte and subjecting it to dedicated purification steps. The diverted flow, also known as "bleed", is compensated for by an addition of fresh acid solution.

One generally wants to limit the quantity of the bleed, as the dedicated purification steps are complex and expensive. To this end, relatively high concentrations of impurities in the electrolyte are to be tolerated.

The presence of impurities in the electrolyte has however a direct impact on the purity of the copper cathodes. Impurities can indeed be included in the cathodes according to different mechanisms. They may co-deposit with the copper by electroplating (e.g. silver and bismuth) or become embedded in the cathodes as precipitates (arsenic, antimony, bismuth) or as particles (lead). The commercial value of the cathodes is directly impacted by these impurities. This problem is further exacerbated when applying current densities above 250 $A/m^2$.

The level of impurities in the cathodes depends on the impurities in the copper-bearing primary or secondary materials being treated. Arsenic is often the most critical element, followed by bismuth. ASTM B115-10 (2016) specifies the limiting amounts of impurities in electrolytic copper "Grade 1" cathodes. According to this standard, arsenic is allowed up to 5 ppm, and bismuth up to 1 ppm. The production of Grade 1 cathodes is certainly desirable, but not mandatory.

The cathode purity problem when dealing with highly contaminated electrolytes, by which is meant that they contain high concentrations of impurities, is often dealt with by grafting a copper solvent extraction process on the electrolyte loop. The electrowinning step is then performed on a nearly pure copper sulfate solution, guaranteeing the highest cathode quality. However, the addition of solvent extraction implies considerable disadvantages such as the capital costs of the installation, and the operational challenges of working with flammable solvents.

The object of the present invention is to provide an alternative solution to the problem of cathode quality when dealing with highly contaminated electrolytes, in particular when they contain high concentrations of arsenic or bismuth. Use is made of gas sparging at the bottom of the electrowinning cells.

Air sparging systems in copper electrowinning cells are known from e.g. US-3,959,112 (A). It has been recognized that these systems enhance the smoothness of the surface of the cathodes. This may be important to suppress the formation of dendrites, which may lead to short circuits between anodes and cathodes. The use of sparging in combination with highly contaminated electrolytes is however not disclosed.

Few efforts have been performed for avoiding inclusion of arsenic or bismuth, since most electrowinning plants work with a solvent extraction between the leaching and electrowinning operations to remove impurities or do not contain these elements in the raw materials before leaching.

The present invention concerns a process for the electrowinning of copper from an acidic copper sulfate solution, wherein the process is performed in electrowinning cells including a plurality of anodes and cathodes, equipped with gas sparging elements, comprising the step of sparging gas, preferably uniformly across the cathodes, and characterized in that the solution comprises more than 100 mg/L of arsenic. The effect of sparging is particularly beneficial when the solution comprises more than 500 mg/L of arsenic, and even more so when the solution comprises more than 2 g/L of arsenic. Suitable solutions may contain 20 to 60 g/L of copper, and 80 to 220 g/L free acid; these concentrations are those that are typically encountered in copper electrowinning.

It is noted that in an electrowinning the anodes are inert anodes, in other words anodes that do not dissolve significantly in the electrolyte under the processing conditions used.

In electrowinning of copper, the anodes themselves are free of copper.

The gas sparging elements are preferably placed lower than the lowest edge of the cathodes.

The gas sparging elements are preferably placed at the bottom of the electrowinning cells.

Sparging can be performed by gas injection at the bottom of the electrowinning cells via tubes that are installed along the length of the cell. They may be positioned perpendicular to the cathodes. The tubes may be either microporous or contain millimeter-sized orifices over their entire length, thereby achieving a uniform distribution of the gas across the cathodes. Arsenic concentration well below 100 mg/L are less of a problem, as the amounts getting embedded in the cathodes then remain tolerable, even when using current densities of 250 $A/m^2$ or more.

The process is also effective to reduce the contamination of the cathodes by bismuth, in particular when the solution comprises more than 1 mg/L of bismuth. Sparging remains useful when dealing with a solution comprising more Bi, such as 10 mg/L or more.

The sparging technology according to the invention indeed provides for a significant abatement of a.o.

arsenic and bismuth in the cathodes.

The quality of the cathodes remains acceptable, or even compatible with Grade 1, for solutions that comprise up to 5 g/L of arsenic and/or up to 200 mg/L of bismuth. Solutions containing even more impurities can still advantageously be processed according to the invention, even though cathodes of lesser quality are then be expected. The above maxima for arsenic or bismuth will rarely be reached in practical situations, as other impurities, such as silver, will dictate a level of bleeding ensuring lower concentrations.

In a preferred embodiment the process is a process for the electrowinning of copper having at most 15 ppm As.

In a preferred embodiment the process is a process for the electrowinning of copper having at most 3 ppm Bi.

Both these limits are consistent with the upper limit allowed for ' Grade 2' copper according to ASTM B115-10 (2016).

The sparging gas can be any non-reacting gas such as nitrogen, but may also contain oxygen. Air is preferred. A gas flow rate between 0.02 and 0.5 normal $m^3/h$ per $m^3$ of solution is preferred. Lower rates may be insufficient to guarantee a clear effect on the cathode quality, while higher rates may produce a prohibitive amount of acid mist when bubbling through the electrolyte.

The designation normal $m^3$ is defined in ISO 2533:1975 and indicates a gas volume expressed at a pressure of 1013 mbar and a temperature of 15° C. In engineering the symbol $Nm^3$ is used for this.

Form an economic perspective, it is advantageous to perform the electrowinning process at a current density of more than 250 $A/m^2$.

The invention also concerns the use of electrowinning cells including a plurality of anodes and cathodes, equipped with gas sparging elements for sparging gas, preferably uniformly across the cathodes, for the recovery of copper from acidic copper sulfate solution also comprising 100 mg/L to 5 g/L of arsenic.

Preferably the gas sparging elements are placed at the bottom of the electrowinning cells.

This above use is preferred for solutions also comprising 1 to 200 mg/L of bismuth.

The invention also concerns a process for the production of copper, wherein an acidic copper sulfate solution is produced by dissolution of one or more raw materials in aqueous sulfuric acid, wherein the acidic copper sulfate solution is subsequently treated in a process for the electrowinning of copper according to the invention. Preferably, the acidic copper sulfate solution is produced by non-electrolytic dissolution and/or in a reactor that is separate from the electrowinning cells.

It is believed that various mechanisms may lead to the incorporation of impurities such as arsenic and bismuth: (i) inclusion of arsenic-, and bismuth-containing solid particles, (ii) arsenic reduction and subsequent co-deposition of copper arsenides, (iii) bismuth plating, and (iv) electrolyte inclusion. These mechanisms are more outspoken when working at higher current densities and when the nucleation of the copper starts. When working at higher current densities, one obtains mixed potentials at the starting sheets, which results in locally very high current densities. The latter results in very porous copper deposits, which leads to the inclusion of electrolyte and particles, and in copper depletion at the surface, which leads to the reduction of bismuth and arsenic with the plating of metallic bismuth and copper-arsenide as a consequence. Therefore, working in abovementioned electrolytes is normally limited to a relatively low and uneconomical current density of less than 200 A/m2.

According to the invention, the above described impurity encapsulation can be mitigated or avoided by sparging. It is assumed that sparging ensures a better mixing at the cathode surface, which results in a decreased thickness of the boundary layer. The depletion of copper, which occurs especially when the current is locally increased, can be avoided in this way. For example, the current density increases significantly during harvesting of the cathodes and re-entering the blanks. Another reason for locally higher current densities, up to 1000 $A/m^2$, is the difference in passivation layer thickness of the stainless-steel blanks. Co-plating of silver and bismuth and formation of copper arsenide occur especially at these occasions of higher current densities. The supply of enough copper ions to the cathode thanks to the improved mixing results in the decreased plating of other elements. The decreased boundary thickness results also in a better copper nucleation at the steel surface and a denser copper structure. This avoids the inclusion of precipitates of arsenic and bismuth.

Examples 1 and 2 illustrate the invention on synthetic solutions containing respectively As and Bi.

Example 3 is performed using actual tankhouse solutions. The bismuth content of these solutions varies considerably, according to the materials being processed by the smelter. In these 3 examples, electrowinning is performed using laboratory scale equipment.

Example 4 is performed in an actual tankhouse. The results obtained with and without sparging are compared.

In all examples lead-based anode were used.

Example 1

Copper sulfate crystals, sulfuric acid and As (as $H_3As_2O_5$) were added to water to form an aqueous solution containing 40 g/L Cu, 2.5 g/L As and 180 g/L $H_2SO_4$. Approximately 0.270 liters of this electrolyte are transferred to two individual Hull cells, each with an anodic surface of 30 $cm^2$ and a cathodic surface of 46 $cm^2$. A current of 2A is applied with a rectifier resulting in a cathodic current density between 75 and 2070 $A/m^2$. In one Hull cell, the electrolyte is sparged with microporous tubes, whereas in the other cell no air is provided. Oxygen evolution is the main reaction at the anode, copper reduction is the main reaction at the cathode. After 3 hours, the experiment is stopped, and the chemical quality of the deposited copper is determined for different zones with varying current densities. At the current density relevant for most electrowinning installations (250 to 500 $A/m^2$), the concentration of arsenic in the cathode from the air-sparging experiment amounts to 1 to 2 ppm, whereas the As concentration in the experiment without sparging amounts to 1700 to 5800 ppm. This is well visible in the physical aspect of the cathodes, as black deposits suggest the formation of copper arsenide, and hence the presence of As.

As, at a concentration of 2.5 g/L is thus strongly suppressed by sparging, down to a level that may be compatible with Grade 1 cathodes.

Example 2

Copper sulfate crystals, sulfuric acid and Bi (as $BiSO_4$) were added to water to form an aqueous solution containing 40 g/L Cu, 200 mg/L Bi and 180 g/L $H_2SO_4$. Approximately 0.270 liters of this electrolyte are transferred to two individual Hull cells, each with an anodic surface of 30 $cm^2$ and a cathodic surface of 46 $cm^2$. A current of 2A is applied with a rectifier resulting in a cathodic current density between 75 and 2070 $A/m^2$. In one Hull cell, the electrolyte is sparged with microporous tubes, whereas in the other cell no air is provided. After 3 hours, the experiment is stopped, and the chemical quality of the deposited copper is determined for different zones with varying current densities. At the current density, relevant for most electrowinning installations (250 to 500 $A/m^2$) the concentration of bismuth in the cathode from the air-sparging experiment amounts to 50 to 1100 ppm, whereas the Bi concentration in the experiment without sparging amounts to 3000 to 5000 ppm.

Bi, at a concentration of 200 mg/L, is thus remarkably well suppressed by sparging, even though the desirable compatibility with Grade 1 criteria is not always obtained.

Example 3

Electrolyte from a copper electrowinning tankhouse containing 37 to 50 g/L Cu, 1.5 to 3 g/L As, 10 to 200 mg/L Bi, and 160 to 200 g/L $H_2SO_4$ was used in this experiment. Approximately 0.270 liters of this electrolyte are transferred to two individual Hull cells, each with an anodic surface of 30 $cm^2$ and a cathodic surface of 46 $cm^2$. A current of 2A is applied with a rectifier resulting in a cathodic current density between 75 and 2070 $A/m^2$. In one Hull cell, the electrolyte is sparged with microporous tubes, whereas in the other cell no air is provided. After 3 hours, the experiment is stopped, and the chemical quality of the deposited copper is determined for different zones with varying current densities. At the current density relevant for most electrowinning installations (250 to 500 $A/m^2$) the concentration of impurities in the cathode from the air-sparging experiment amounted to 1 to 2 ppm As, and 1 to 10 ppm Bi, whereas the impurity concentration in the experiment without sparging amounted to 20 to 1000 ppm As, and 180 to 650 ppm Bi.

As and Bi, at concentrations of up to 3 g/L and 200 mg/L respectively, are well suppressed by sparging, down to a level that may be compatible with Grade 1 cathodes for As.

Example 4 Two commercial electrowinning cells were used in this experiment, having each a separate recirculation tank but a common rectifier. Each cell contained 40 anodes and 39 cathodes with a surface area of 0.84 $m^2$ each. One cell was operated with air sparging tubes at the bottom of the cell, whereas no air sparging was provided in the other cell. During the experiments, the current density was varied between 275 $A/m^2$ and 425 $A/m^2$. The typical electrolyte composition amounted to 37 to 50 g/L Cu, 1.5 to 5 g/L As, 10 to 20 mg/L Bi, and 160 to 200 g/L $H_2SO_4$ was used in this experiment. Cathodes were grown for approximately 7 days and harvested when the thickness was between 6 and 10 mm. After harvesting and stripping, 50 kg of sample was collected by punching copper on the diagonal of the cathode. The sample was smelted in an induction oven and the impurity concentration was determined by spark optical emission spectroscopy. The concentration of impurities is reported in Table 1.

TABLE 1

Concentration (ppm) of impurities in cathodes

| Sparging | Current density ($A/m^2$) | As (ppm) | Bi (ppm) |
|---|---|---|---|
| No | 310 | 5 | 2 |
| Yes | 310 | 1 | 1 |
| No | 370 | 4 | 3 |
| Yes | 370 | 1 | 1 |

As and Bi, at concentrations of up to 5 g/L and 20 mg/L respectively, are remarkably well suppressed by sparging, down to a level that meets the criteria for Grade 1 cathodes for As and Bi.

The invention claimed is:

1. A process of electrowinning copper from an acidic copper sulfate solution, wherein the process is performed in electrowinning cells including a plurality of cathodes and lead-based anodes, equipped with gas sparging elements, the process comprising the step of sparging gas across the cathodes, wherein the solution comprises 37 to 60 g/L of copper, more than 100 mg/L of arsenic and more than 1 mg/L of bismuth, wherein the solution comprises up to 5 g/L As, and/or up to 200 mg/L of Bi, and wherein the sparging gas is air.

2. The process according to claim 1, wherein the flow rate of the sparging gas is between 0.02 and 0.5 normal $m^3/h$ per $m^3$ of solution.

3. The process according to claim 1, wherein the electrowinning process is performed at a current density of more than 250 $A/m^2$.

4. The process according to claim 1, wherein the process is a process for the electrowinning of copper having at most 15 ppm As.

5. The process according to claim 1, wherein the process is a process for the electrowinning of copper having at most 3 ppm Bi.

6. A process of producing copper comprising producing an acidic copper sulfate solution by dissolution of one or more raw materials in aqueous sulfuric acid, and subsequently treating the acidic copper sulfate solution in a process according to claim 1.

7. The process of producing copper according to claim 6, wherein dissolution comprises non-electrolytic dissolution.

8. The process of producing copper according to claim 6, wherein the acidic copper sulfate solution is produced in a reactor that is separate from the electrowinning cells.

* * * * *